US005984768A

United States Patent [19]

Tolley

[11] Patent Number: 5,984,768

[45] Date of Patent: Nov. 16, 1999

[54] CUT-OFF AND GRIND PIN-MACHINING FIXTURE

[76] Inventor: Roland H. Tolley, P.O. Box 1106, Black Mountain, N.C. 28711

[21] Appl. No.: 08/947,425

[22] Filed: Oct. 8, 1997

[51] Int. Cl.[6] ..... B24B 21/00

[52] U.S. Cl. ..... 451/365; 269/71

[58] Field of Search ..... 451/365, 380, 451/387, 389, 405; 269/902, 155, 71, 82

[56] References Cited

U.S. PATENT DOCUMENTS

| | | | |
|---|---|---|---|
| D. 333,826 | 3/1993 | Giangrasso . | |
| 709,399 | 9/1902 | Emmert | 269/71 |
| 979,305 | 12/1910 | Hunt | 269/71 |
| 1,071,289 | 8/1913 | Bader . | |
| 4,400,969 | 8/1983 | Specktor | 269/71 |
| 4,418,901 | 12/1983 | Woods et al. | 269/71 |
| 4,650,379 | 3/1987 | Jaskolski . | |
| 4,984,775 | 1/1991 | Kahike | 269/71 |
| 5,172,895 | 12/1992 | Klimach . | |
| 5,305,557 | 4/1994 | Warncke . | |
| 5,377,963 | 1/1995 | Lehman . | |
| 5,452,885 | 9/1995 | Beere . | |

FOREIGN PATENT DOCUMENTS

| | | | |
|---|---|---|---|
| 3509935A1 | 9/1985 | Germany | 269/71 |

*Primary Examiner*—David A. Scherbel
*Assistant Examiner*—Daniel G. Shanley
*Attorney, Agent, or Firm*—Carter & Schnedler, P.A.

[57] ABSTRACT

A fixture for retaining mold pin workpieces for separate cut-off and precision grinding operations, facilitating the efficient machining of quantities of mold pins to close tolerances, when employed in combination with a machine such as a manual surface grinder, or other machining tool. The fixture includes a base pate, with a vertically upstanding cylindrical post secured to the base plate. A head assembly is slidably mounted on the post for both vertical position adjustment and rotational (angular) adjustment. A vertically-extending graticule line on the post and a graduated degree scale on the head assembly cooperate to facilitate rotational adjustment of the head assembly to particular angles. In addition, the base plate has primary side and secondary positioning reference edges oriented at precise angles. The head assembly has a pin-clamping portion extending horizontally from the post to a distal end generally along a head assembly axis perpendicular to the post. A first stationary jaw is located on a side of the pin-clamping portion adjacent to the distal end and has a horizontally-oriented V-groove facing away from the head assembly axis for orienting a workpiece pin parallel to the head assembly axis during a cut-off operation. A second stationary jaw is located at the distal end and has a vertically-oriented V-groove facing away from the post for orienting a workpiece pin perpendicular to the head assembly axis during a precision grinding operation.

15 Claims, 7 Drawing Sheets

CUT-OFF AND GRIND PIN-MACHINING FIXTURE

BACKGROUND OF THE INVENTION

The present invention relates generally to the machining of mold pins and, more particularly, to a fixture for retaining workpieces for separate cut-off and precision grinding operations, facilitating the efficient machining of quantities of mold pins to close tolerances.

Mold pins, such as punch pins, ejector pins and core pins, are employed in large numbers and in a wide variety of sizes and shapes. Multiple copies of the same mold pin configuration are often required, so that the same precision machining operations are repeated over and over.

Hardened steel pin blanks, of precise diameters ranging from very small diameters to one and one-half inches, and ranging in length to twelve inches and longer, are obtained from a manufacturer. The pin blanks have an elongated cylindrical shaft, and an enlarged mounting head. The pin blanks are then precision-cut by a machinist to desired lengths. Normally, a batch of pins is made at one time. The cutting to length must be very precise, with a precise, flat grind on the end.

Making pins from a blank typically involves two steps: First, an initial rough cut is made, employing a cut-off wheel to establish the approximate length. Then, a final precision grinding operation is performed, to establish the final length and to make the end flat.

Traditionally, machinists make these pins employing a variety of clamps, but no particularly efficient technique is generally used. Typically, a simple V-block fixture is held in a vice.

Specialized fixtures for machining mold pins are disclosed for example in Jaskolski U.S. Pat. No. 4,650,379 and Lehman U.S. Pat. No. 5,377,963. While the Jaskolski and Lehman fixtures are perhaps of some benefit, there nevertheless remains a need for a fixture which facilitates efficient machining of mold pins in a wide variety of sizes and configurations.

SUMMARY OF THE INVENTION

Accordingly, it is an object of the invention to provide a fixture for efficiently and repeatedly retaining mold pin blanks for separate cut-off and grind operations, whereby a batch of substantially identical pins may be machined.

It is a related object of the invention to provide such a fixture which accommodates a wide variety of pin lengths and diameters.

It is another related object of the invention to provide a fixture which can be adjusted very quickly to accommodate pins of different lengths.

It is yet another object of the invention to provide a fixture which facilitates a partial pin grind operation.

It is a related object of the invention to provide such a fixture which is capable of precision adjustment for partial pin grind operations.

In accordance with the invention, a fixture for pin machining includes a base plate, and a vertically upstanding post secured to the base plate. Slidably mounted on the post for at least vertical position adjustment, and preferably also for rotational adjustment in the case of a post which is cylindrical, is a head assembly. The head assembly has a pin-clamping portion extending horizontally from the post to a distal end generally along a head assembly axis perpendicular to the post. Included on a side of the pin-clamping portion adjacent the distal end of the head assembly is a first stationary jaw having a horizontally-oriented workpiece-locating groove, such as a V-groove, facing away from the head assembly axis for orienting a workpiece pin parallel to the head assembly axis. The head assembly additionally includes at the distal end a second stationary jaw, having a vertically-oriented workpiece-locating groove, such as a V-groove facing away from the post, for orienting a workpiece pin perpendicular to the head assembly axis The first stationary jaw may also have a secondary horizontally-oriented workpiece-locating aperture parallel to the head assembly axis, useful for holding smaller workpieces.

Preferably, the second stationary jaw includes a relatively taller jaw element and a relatively shorter jaw element, having respective vertically-oriented workpiece-locating grooves. The head assembly is reversible on the post such that either one of the jaw elements may be selectively positioned above the other, facilitating the selective clamping of workpiece pins of different lengths against the workpiece-locating grooves.

There is at least one clamp element for selectively clamping a workpiece pin either against the horizontally-oriented workpiece-locating groove of the first stationary jaw or a horizontal cut-off operation or against the vertically-oriented workpiece locating groove of the second stationary jaw for a vertical precision granting operation.

For positively and accurately locating each of a batch of workpiece pins to be cut off to identical lengths and clamped one at a time in the first stationary jaw, the head assembly additionally has an adjustable stop element, in the form of an adjustable stop rod extending along the side of the pin-clamping portion, parallel to the head assembly axis. This stop element is thus positioned for engaging an end of the workpiece pin for positively locating the work piece pin.

The base plate has a primary positioning reference edge perpendicular to the head assembly axis when the head assembly is rotationally in a reference position, located farther from the post than the head assembly distal end. Additionally, the base plate has at least one side positioning reference edge at a 90° angle with reference to the primary positioning reference edge, as well as at least one secondary positioning reference edge at a 45° angle with reference to the primary positioning reference edge.

To facilitate rotational adjustment of the head assembly to particular angles, the post has a vertically-extending graticule line, and the head assembly has a graduated degree scale cooperating with the graticule line.

For more precise adjustment, without having to rely on the graduated degree scale, the head assembly has at least one tooling hole on a tooling hole axis parallel to the post, and located intermediate the post and the distal end. A tooling adjustment element is provided, having a plug portion received in the tooling hole, and a cylindrical reference portion having the same diameter as the post. For adjusting the head assembly to a desired rotational position on the post, the fixture is laid on its side on a flat table with the side positioning reference edge on the flat table. The lower surface of a calibrated tooling flat angle is placed across the post and the cylindrical reference portion. Then, the head assembly is rotationally adjusted until an upper surface of the tooling flat angle is parallel to the flat table, for example employing a dial indicator.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description, taken in conjunction with the drawings, in which:

FIG. 6 illustrates another configuration whereby a workpiece pin may be retained by the fixture, employing in addition a gage block as a spacer element so that the pin can be machined to a length which is a precise increment shorter than a previous in;

DETAILED DESCRIPTION

Figure 1A:
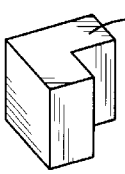
FIG. 1A depicts in isolation a V-block insert which can be employed as a spacer.
Figure 1:
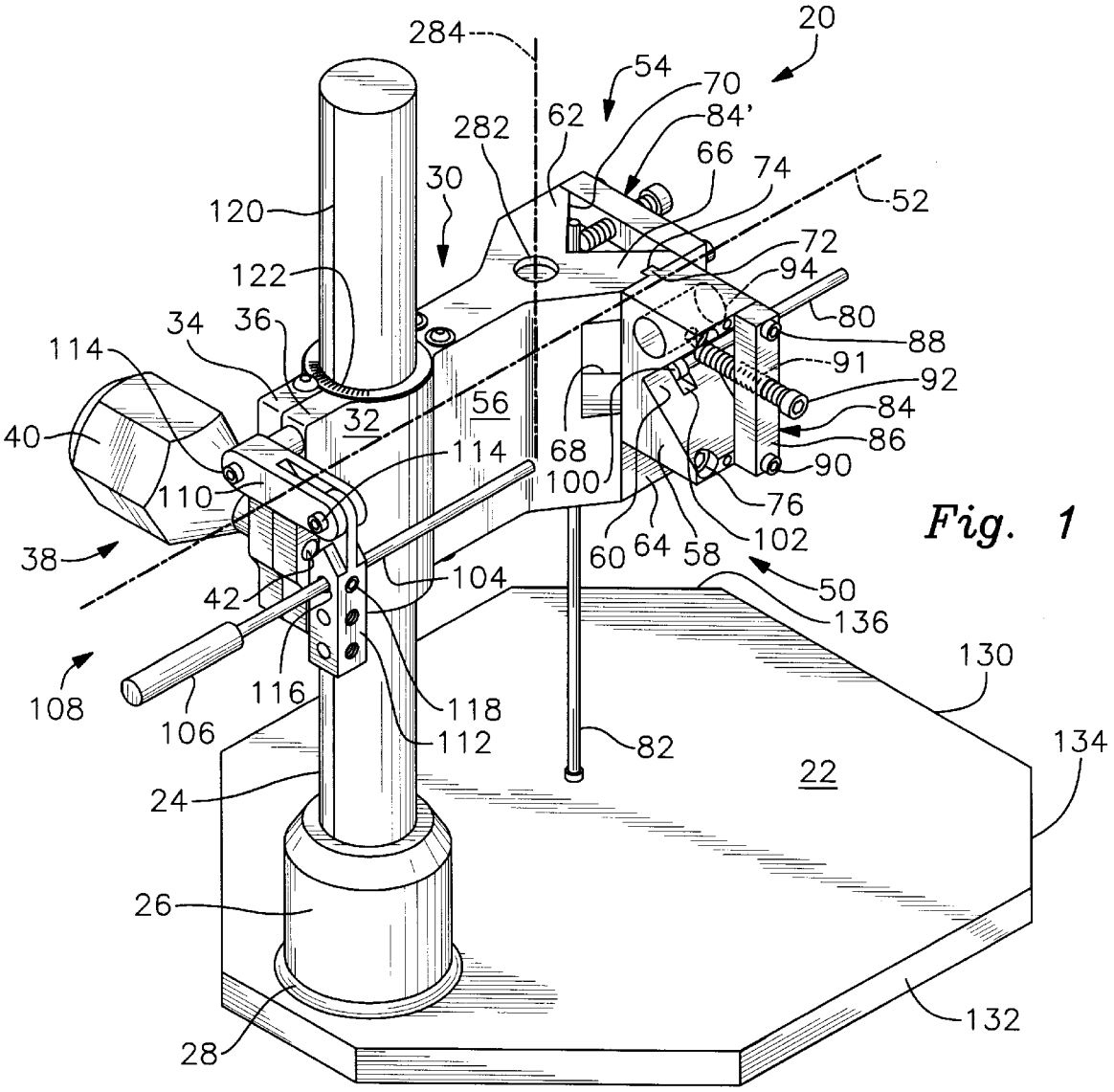
FIG. 1 is a three-dimensional overview of a fixture in accordance with the invention showing, for purposes of illustration only, a workpiece pin in the horizontal position for an initial cut-off operation, and another pin in a vertical orientation for a final precision grind operation.

Referring first to FIG. 1, a fixture 20 in accordance with the invention has a base plate 22, and a vertically upstanding post 24 secured to the base plate, perpendicular thereto. For rigidity, the base plate 22 is for example one-half inch in thickness, and the post 24 is for example one and one-fourth inches in diameter. The post 24 is securely retained within a mounting sleeve 26 welded as at 28 to the base plate 22.

FIG. 1 is generally from what may be termed the "rear" of the fixture 20, where the post 24 is attached. Facing the upper right in the FIG. 1 orientation is the "front" of the fixture 20.

Slidably mounted on the post 24 is a head assembly, generally designated 30. The head assembly 30 includes a sleeve 32 surrounding the post 24. The sleeve 32 is split towards the rear of the fixture 20 and integrally joined to a pair of flanges 34 and 36, slightly spaced from each other, so that a clamping force is exerted to retain the head in any desired position, both vertically and rotationally, on the post 24. For clamping the head assembly 30 to the post 24, a clamping screw 38 is provided, having an enlarged head 40 suitable for gripping either by hand or by a wrench, and a threaded portion 42 which passes through an aperture (not shown) in flange 34 and engages corresponding screw threads (not shown) in flange 36.

Opposite the flanges 34 and 36 and clamping screw 38, and facing the "front" portion of the fixture 20, is a pin-clamping portion of the head assembly 30, generally designated 50. The main structure of pin-clamping portion 50 is likewise integral with the sleeve 32, and extends horizontally from the sleeve and therefore the post 24 generally along a head assembly axis 52 perpendicular to the post 24. The pin-clamping portion 50 extends to a distal end, generally designated 54.

On one side 56 of the pin-clamping portion 50 adjacent to distal end 54 is a first stationary jaw 58 having a horizontally oriented workpiece-locating groove 60 in the illustrative form of a V-shaped groove 60, facing away from the head assembly axis 52 for orienting a workpiece pin parallel to the head assembly axis 52 during a cut-off operation. Although a V-shaped groove is presently preferred, other groove configurations may be employed.

At the distal end 54 is a second stationary jaw 62, including two shorter separate jaw elements, a relatively taller jaw element 64 and a relatively shorter jaw element 66. The jaw elements 64 and 66 have respective vertically-oriented workpiece-locating grooves 68 and 70, illustrated as V-shaped grooves 68 and 70. The V-shaped grooves 68 and 70 face away from the post 24 and orient a workpiece pin perpendicular to the head assembly axis 52 during a precision grinding operation. Other groove configurations may be employed.

In the particular construction illustrated, the second stationary jaw 62 is integral with the main structure of the pin-clamping portion 50 and with the sleeve 32. The first stationary jaw 58 is formed as a separate block assembly located by a tongue 72 and groove 74 configuration, and retained in position by machine screws 76.

It will be appreciated that the head assembly 30 is reversible on the post 24 such that either one of the jaw elements 64 and 66 may be selectively positioned above the other, to facilitate clamping of workpiece pins of different lengths, as is described in greater detail hereinbelow with reference to FIGS. 4–7.

By way of example, two workpiece pins 80 and 82 are shown held into the stationary jaws 58 and 62 by respective clamp elements 84 and 84'. Pin 80 is held horizontally for an initial cut-off operation, and pin 82 is held vertically for a final precision grinding operation. During actual operation, only one of the workpiece pins 80 and 82 is held at a time, but two are shown in FIG. 1 for purposes of illustration. Similarly, although separate clamp elements 84 and 84' are illustrated, in actual practice, only one clamp element 84 is required, which may be moved between the fixed jaw 58 and either one of the vertical jaw elements 64 and 66.

The clamp element 84 more particularly includes a solid bar 86 fastened to the stationary jaw 58 by a pair of machine screws 88 and 90 passing through suitable apertures near the ends of the bar 86, and received in threaded apertures (not shown) of the fixed jaw 58. To facilitate adjustment by having to loosen only but not remove the machine screws 88 and 90, at least one end of the bar 86 may be cut away so that the bar 86 can simply be swiveled.

The bar 86 of the clamp element 84 includes a central threaded aperture 91, into which a clamping machine screw 92 is threaded, so as to bear against the representative workpiece pin 80, pressing the pin 80 against the sides of the horizontal V-shaped groove 60.

Although not clearly visible in FIG. 1, it will be appreciated that the representative vertically-extending workpiece pin 82 is similarly clamped in position.

The illustrated clamp element 84 is particularly suited for relatively small diameter workpiece pins 80 and 82. For larger diameter workpiece pins (not shown), a different clamp element 84 may be employed, such as a saddle-type clamp bowing outwardly (not shown) from the stationary jaw 58 or 62.

FIG. 1A depicts in isolation a V-block insert 93 which can be employed as a spacer within the V-shaped grooves 60, 68 and 70 to facilitate grinding pins having very small diameters.

For holding certain smaller workpieces, a secondary horizontally-oriented workpiece-locating aperture 94 is provided in the first stationary jaw 58, parallel to the head assembly axis 52. Workpieces may be retained within the aperture 94 by means of a clamping screw (not shown) received in a threaded hole 96.

One of the features of the subject invention is its versatility in being able to accommodate workpiece pins in a variety of lengths. Thus, in the FIG. 1 illustration, the particular workpiece pin 80 is relatively short, and has an enlarged cylindrical head 100 received within a clearance recess 102 within the V-groove of the first stationary jaw 58.

Figure 2:
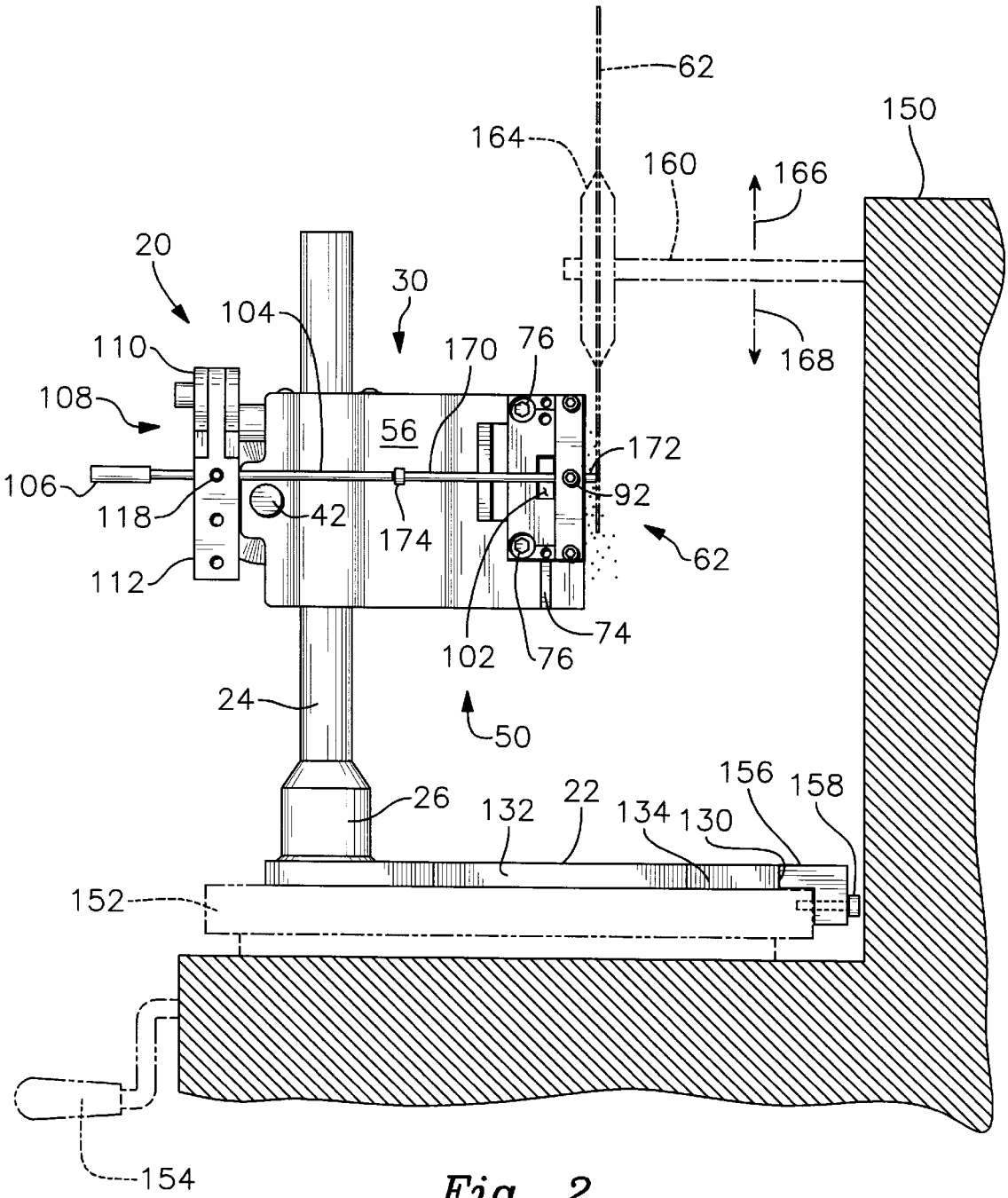
FIG. 2 is a side elevational view showing the fixture of the invention in use during an initial cut-off operation.

For positively locating each of a batch of longer workpiece pins held in the horizontal V-groove of the first stationary jaw 58 for cut-off, an adjustable stop element 104 is provided, adjacent the side 56 of the pin-clamping portion 50, for engaging the head end of a workpiece pin as illustrated in FIG. 2, described hereinbelow.

In FIG. 1, the stop element 104 takes the form of an adjustable stop rod 104, having a handle 106 and adjustably retained in an adjustable bracket 108 including a pair of swivel links 110 and 112. The swivel links 110 and 112 are retained in a desired position by means of machine screws 114. The adjustable stop rod 104 passes through an aperture 116 in the swivel link 112, and is retained by a set screw 118.

To facilitate rotational or angular adjustment of the head assembly 30 on the post 24, the post 24 has a vertically-extending graticule line 120, and the head assembly 30 has a graduated degree scale 122 cooperating with the graticule line 120. The graduated degree scale 122 may for example have indicia (not shown) at appropriate angular intervals and ranging from −45° to +45°. The ability to rotatively adjust the head assembly 30 on the post 24 to particular angles facilitates partial pin grinds, described hereinbelow with reference to FIG. 8.

In FIG. 1, the head assembly 30 is rotationally positioned in what may be described as a reference position. Although not clearly shown, it will be appreciated that the degree scale 122 has a 0° mark in alignment with the graticule line 120 when the head assembly 30 is in the reference position, regardless of the vertical position of the head assembly 30 on the post 24.

Related to the angle of the head assembly 30, the base plate 22 has a primary positioning reference edge 130 which is perpendicular to the head assembly axis 52 when the head assembly 30 is rotationally in the reference position, facing the "front" of the fixture 20. Preferably, the primary positioning reference edge 130 is located farther than the post 24 than is the head assembly distal end 54.

In addition, the base plate 22 has at least one side positioning reference edge 132, at a 90° angle with reference to the primary positioning reference edge 130. The base plate 22 also has secondary positioning reference edges 134 and 136, each at a 45° angle with reference to the primary positioning reference edge 130.

Referring next to FIG. 2, shown is a cut-off operation wherein the fixture 20 is employed for example in combination with a manual surface grinder 150, depicted in highly schematic representation. Although a manual surface grinder 150 is represented in the example, the fixture 20 may be employed in combination with a variety of other machines such as, but not limited to, automatic grinders and tool and cutter grinders.

The grinder 150 includes a workpiece table 152 which magnetically secures workpieces, in this case the base plate 22, such that the base plate 22 is relatively immovably attached to the table 152 when an electromagnet (not shown) therein is energized, or a permanent magnet chuck (not shown) is engaged. The manual surface grinder 150 includes a crank handle 154. Rotation of the crank handle 154 causes lateral movement of the table 152, which movement in the FIG. 2 orientation is in and out of the plane of the drawing sheet.

A flanged back rail 156 secured by means of a representative machine screw 158 positively positions the primary positioning reference edge of the base plate 22 so that the base plate 22 is square with reference to the table 152 (magnetic chuck), and with reference to the grinder 150 in general.

Projecting horizontally from the manual surface grinder 150 is a motor-driven rotating shaft 160 to which various cutting wheels, such as grinding wheels, are conventionally attached, depending upon the particular operation to be performed. Attached to the shaft 160 in FIG. 2 is a cut-off wheel 162, supported in part by a stiffening hub 164. As indicated by arrows 166 and 168, the shaft 160 of the surface grinder 150 is adjustable up and down by means of another crank handle (not shown).

Secured to and positively located by the V-groove 60 of the first stationary jaw 58, and clamped by means of the clamp element 84, is a workpiece pin 170 which has a distal end 172 being cut to approximate length, and a head end 174. To positively locate the head end 174, the adjustable stop rod 104 is suitably positioned.

Thus, in operation, once the fixture 20 and grinder 150 are set up, a batch of workpiece pins 170 can be efficiently cut off to the same approximately length. Each workpiece pin 170 is clamped into the fixture 20, with the head end 174 contacting the stop rod 104. The crank handle 154 is operated, so that the table 152 and the fixture 20 move the workpiece pin 170 into the cut-off wheel 162.

Figure 3:
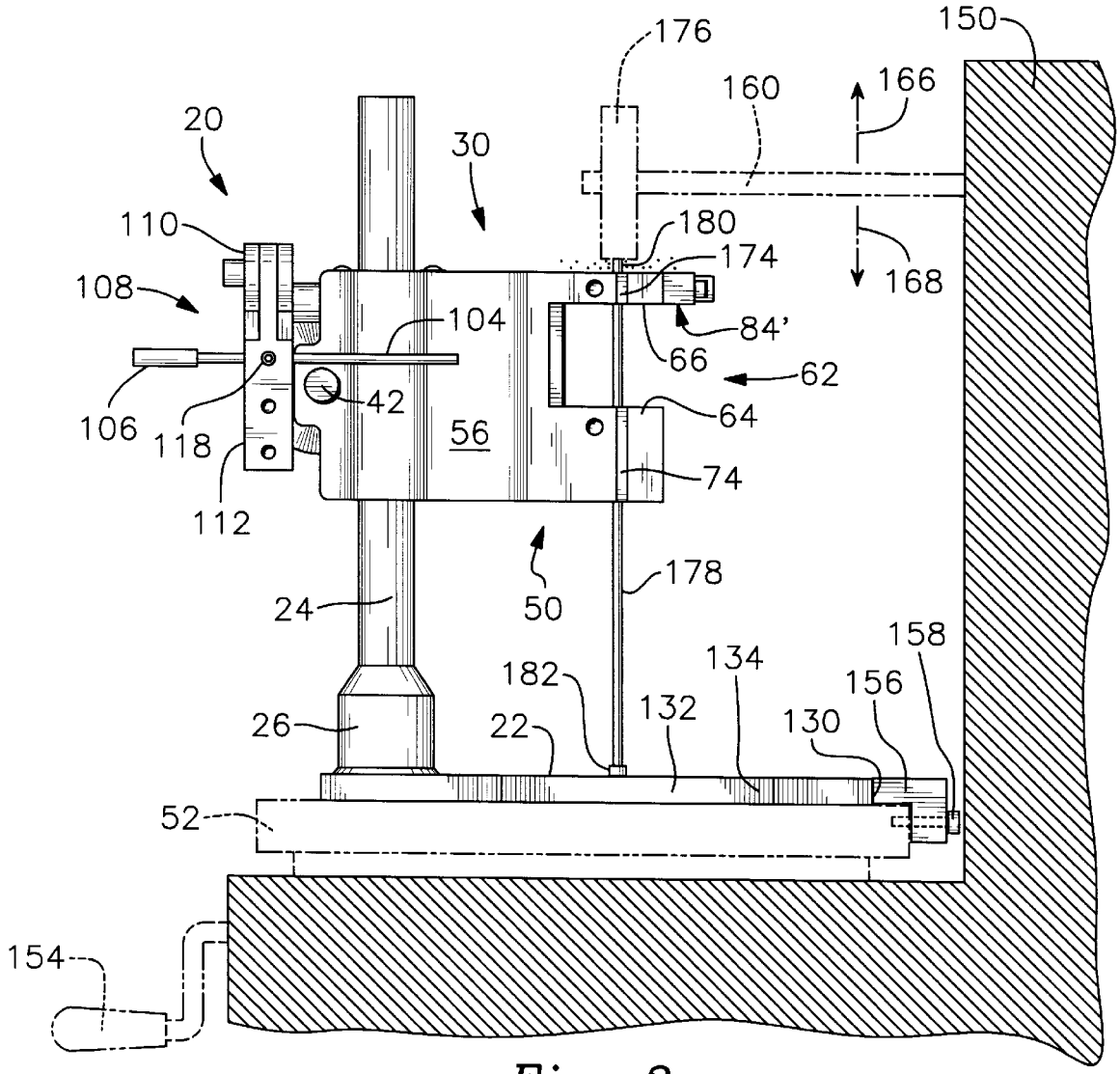
FIG. 3 is a similar side elevational view showing the fixture of the invention in use during a precision final grind operation.

FIG. 3 is a similar view, depicting a precision grinding operation, employing the same fixture 20 and the same grinder 150, except for the substitution of a carefully dressed grinding wheel 176 for the cut-off wheel 162. The dressed grinding wheel 176 which provides a precision surface grind. In FIG. 3, for clarity of illustration, the first stationary jaw 58 has been removed. In actual practice, the stationary jaw is left in place at all times (although the clamping element 84 may be removed), as there is no interference caused thereby.

In FIG. 3, a workpiece pin 178 having a distal end 180 and a head end 182 is clamped into the vertically-oriented V-groove 70 of the relatively shorter jaw element 66 of the second stationary jaw 62, by means of the clamp element 84. The head 182 of workpiece pin 178 resting on the base plate 22 provides a positive reference point determining the final length of the workpiece pin 178, after suitable adjustment of the fixture 20 and grinder 150. Thus, the head assembly 30 is adjusted vertically on the post 24 so that the distal end 180 of the workpiece pin 178 projects just slightly above so as to be held rigidly near the point of the machining operation, and the manual surface grinder 150 shaft 160 is vertically adjusted so that the periphery of the grinding wheel 170 is at a precise desired distance from the workpiece base plate 22.

As the handle 154 is turned, the table 152 (magnetic chuck) and the fixture 20 carry the distal end 180 of the workpiece pin 178 into and across the grinding wheel 170. In the case of an automatic grinder, the workpiece pin 178 is automatically carried into and across the grinding sheet.

Again, it will be appreciated that an entire batch of workpiece pins 174 can be ground to the same length within close tolerances, rapidly and efficiently, as very little time is required to clamp and unclamp workpiece pins 174 within the second stationary jaw 62.

In addition, it will be appreciated that the fixture 20 can be adjusted very quickly to accommodate workpiece pins of different lengths. Thus the one clamping screw 38 with its enlarged head 40 allows the head assembly 30 to be quickly located and unlocked for fixture 20 adjustment.

Although not illustrated in FIG. 3, the fixture 20 may also be employed for precision dressing of the grinding wheel 170, by clamping a diamond-tipped wheel dressing tool into the second, vertically-oriented stationary jaw 62 in place of the workpiece pin 174. To dress the grinding wheel 170, the shaft 160 is moved in and out (left and right with reference to the drawing sheet) using provided controls (not shown) on the grinder 150.

FIGS. 4, 5, 6, and 7 illustrate the manner in which workpiece pins of different lengths may be readily accommodated in the vertically-oriented stationary jaw of the invention. The different configurations of FIGS. 4–7 allow the fixture 20 to be employed for precision grinding of workpiece pins of a wide variety of different lengths within the geometrical constraints of the manual surface grinder 150. In addition, and as described hereinbelow with reference to FIG. 6, workpiece pins can be machined to lengths differing by a precise increment. In each case, precision locating of the workpiece pin is achieved whereby an entire batch of pins may be precision ground to the same length, or to lengths differing by precise increments, within close tolerances.

Figure 4:
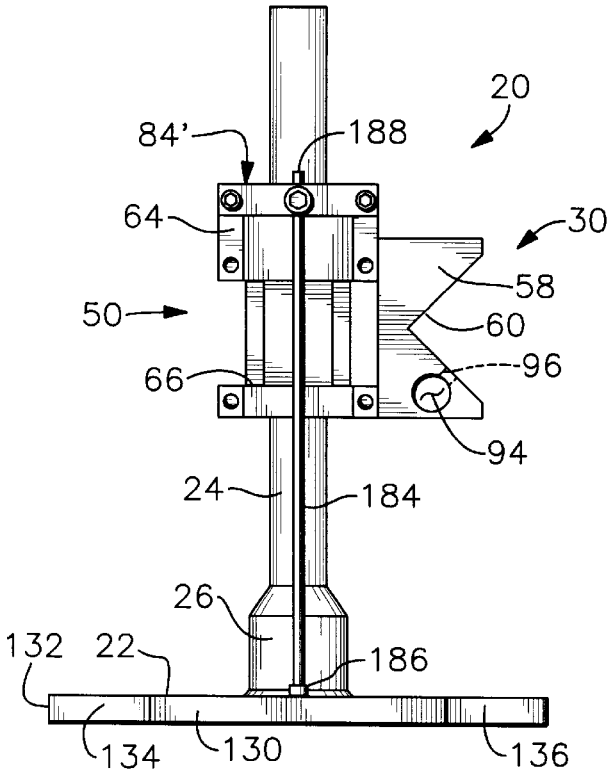
FIG. 4 illustrates a configuration from whereby a relatively long workpiece pin is vertically retained in the fixture during a precision grinding operation.
Figure 5:
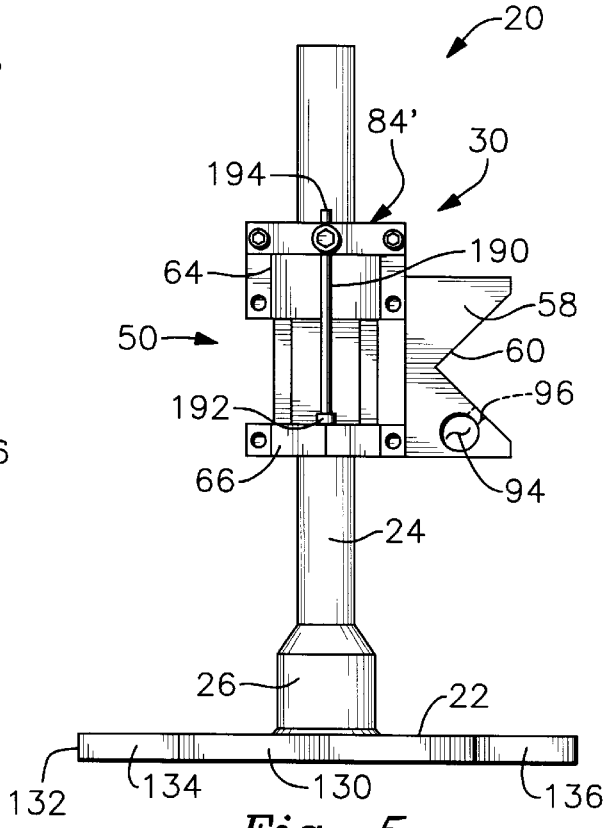
FIG. 5 illustrates a configuration whereby a shorter workpiece pin may be retained by the fixture during a pin grinding operation.
Figure 6:
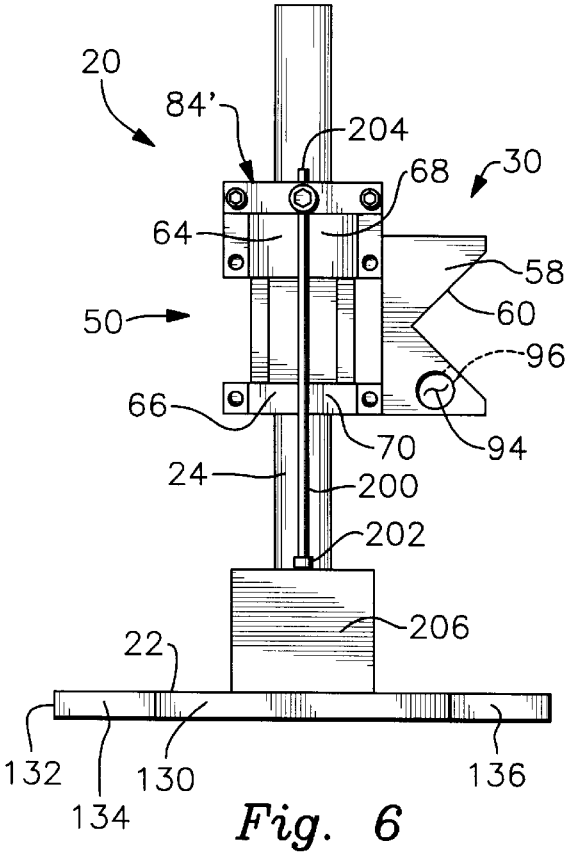
Figure 7:
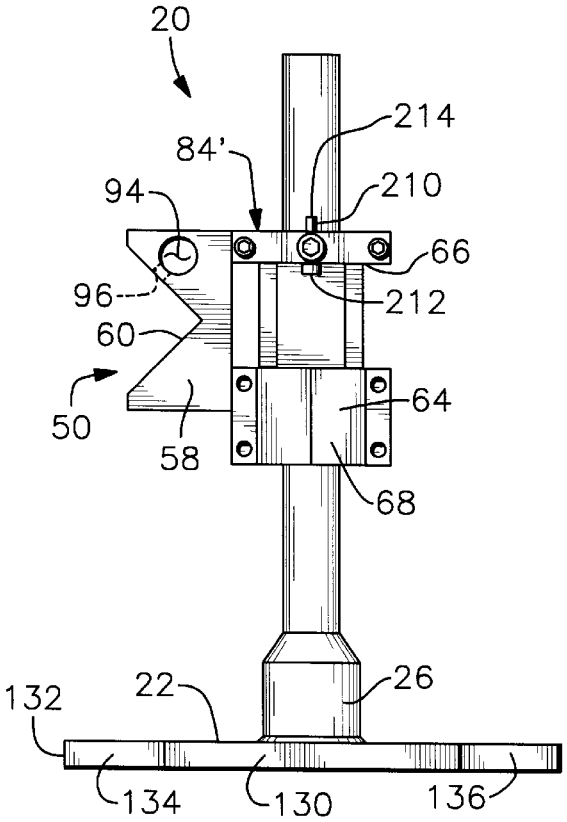
FIG. 7 illustrates a configuration whereby an extremely short pin may be held in the fixture during a precision grinding operation.

In FIGS. 4, 5 and 6, the head assembly 30 is reversed on the post with reference to the orientation depicted in FIGS. 1–3 so that the relatively taller jaw element 64 is positioned above the relatively shorter jaw element 66. In FIG. 7 the relatively shorter jaw element 66 is positioned above the relatively taller jaw element 64, to accommodate an extremely short workpiece pin.

Thus, in FIG. 4, a relatively long workpiece pin 184 has its head 186 resting on the base plate 22, and its distal end 188 in position for precision grinding. The FIG. 4 orientation is substantially identical to that of FIG. 3, except that the position of the head assembly 30 is reversed on the post 24 with referenced to FIG. 3.

FIG. 5 depicts a shorter workpiece pin 190, having a head 192 and a distal end 194, with the head 192 resting on the relatively shorter jaw element 66, which is below the relatively taller jaw element 64 in this particular orientation. The head 194 of the workpiece pin 190 is able to rest on the relatively shorter jaw element 66, notwithstanding the V-groove 70, because the head 194 has a diameter greater than that of the shaft of the workpiece pin 190.

FIG. 6 depicts a variation wherein a workpiece pin 200 with a head 202 and a distal end 204 has its head 202 resting on a precision gauge block or spacer 206. Gage blocks 206 of different heights may be employed, depending upon the particular pin 200 length. The FIG. 6 configuration is of particular benefit when it is desired to machine workpiece pins 200 to lengths differing by a precise increment, the increment being defined by the height of the gage block 206. Thus a first pin (or a first batch of pins) is machined employing the configuration of FIG. 4 (no gage block), and then a second pin (or a second batch of pins), is machined employing the configuration of FIG. 6, with the gage block 206 in place and with no other fixture 20 or grinder adjustments.

In FIG. 7, an extremely short workpiece pin 210 having a head 212 and a distal end 214 is clamped into the relatively shorter jaw element 66, and located by having the underside of the head 212 (the top surface in the FIG. 7 orientation) positively located against the lower surface (in the FIG. 7 orientation) of the relatively shorter jaw element 66.

In addition to simple cut-off and precision grinding operations as discussed hereinabove with reference to FIGS. 2–7, the fixture 20 of the invention may advantageously be employed for accurate angle grinds.

Figure 8:
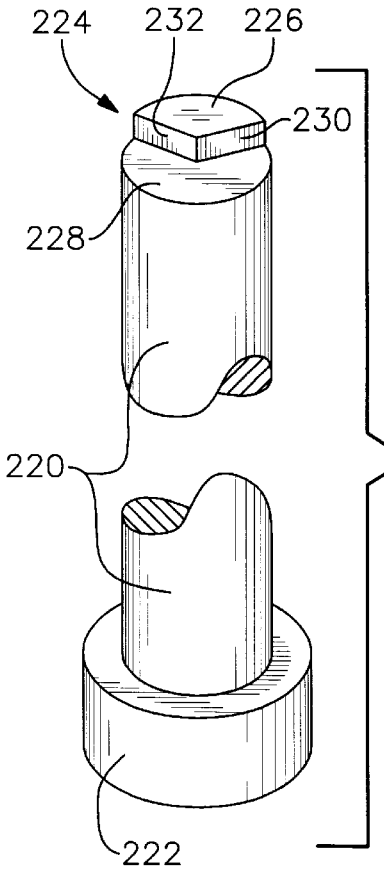
FIG. 8 is an enlarged view of a workpiece pin with a precision angle grind on one end.

Thus, FIG. 8 depicts a workpiece pin 220 having a head 222 and a distal end 224, which has been subjected to a first precision grinding operation to produce a first precision surface 226 defining an overall length, and a pair of subsequent grinding operations at precise angles to produce a second precision surface 228 and walls 230 and 232. The walls 230 and 232 are ground to a precise angle with reference to each other.

To machine the workpiece pin 220 of FIG. 8, the workpiece pin 220 is clamped into the second stationary jaw 62, and left in a clamped position. The head assembly 30 is rotated on the post 70, for example employing the graticule line 120 and graduated degree scale 122, to determine when a particular desired angular adjustment has been achieved. It will be appreciated that, due to the squareness of the fixture, in particular the relationship between the primary positioning reference edge 130 of the base plate 22, the head assembly axis 52 and the graticule line 120, precision orientation is achieved. Thus, the head assembly 30 is rotated to a desired angular position, and a precision grinding operation is performed, generally employing the configuration of FIG. 3, except with the grinding wheel 170 traversing only a portion of the diameter of the workpiece pin 220.

Then, without removing unclamping the workpiece pin 220 from the second stationary jaw 62, the head assembly 30 is rotated to a different angular position, and a second grinding operation is performed.

In situations where an exact 45° angle is required for a partial pin grind, rather than rotating the head assembly 30, the fixture 20 can be positioned on the surface grinder 150 table 152 with either of the secondary reference edges 134 or 136 located against the back rail of FIG. 3.

Figure 9:
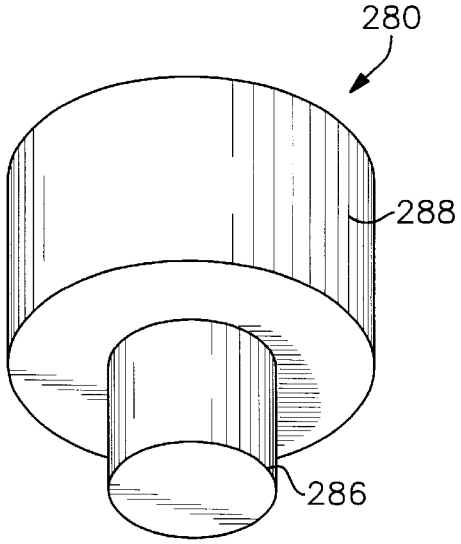
FIG. 9 shows a tooling adjustment element, in the form of a temporary tooling plug, employed for precision adjustment of the fixture for a partial pin grind.
Figure 10:
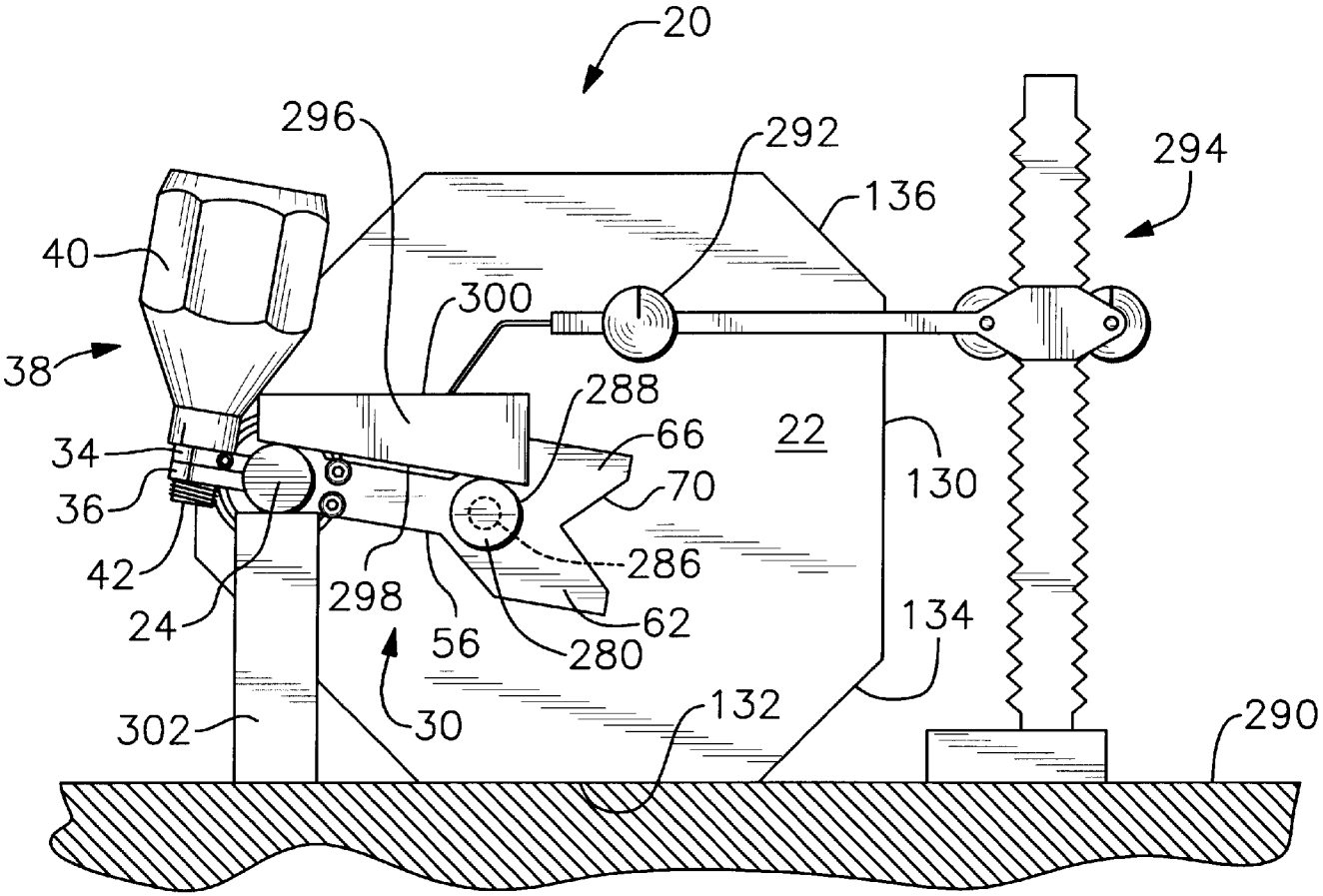
FIG. 10 depicts the use of the tooling adjustment element of FIG. 9 for precision fixture adjustment.

Referring finally to FIGS. 9 and 10, in cases where extremely precise angles are required, to a tolerance tighter that can be achieved by use of the graticule line 120 and graduated degree scale 122, a temporary tooling adjustment element, which may simply be referred to as a tooling plug 280 is employed.

Cooperating with the tooling adjustment element is at least one tooling hole 282 in the head assembly 30, on a tooling hole axis 284 which is parallel to the post 24. Hidden in FIG. 1 is another tooling hole on the underside of the head assembly 30 in the FIG. 1 orientation, identical to the visible tooling hole 282.

The tooling hole 282 is located intermediate the post 24 and the distal end 54. For example, the center line of the tooling hole 282 may be located two and one-half inches from the center line of the post 24.

The tooling adjustment element 280 has a plug portion 286 which is received in the tooling hole 282, and a cylindrical reference portion 288 having the same diameter as the post 24, for example one and one-fourth inches.

For adjusting the head assembly 30 to a desired rotational position on the post 24, more accurately than can be achieved employing the graticule line 120 and the graduated degree scale 122.

In FIG. 10, several additional tools are employed for adjustment of the fixture 20, in particular, angular adjustment of the head assembly 30 on the post 24. These additional tools include a flat table 290 in the form of a granite surface plate 290, a dial indicator 292 supported on an adjustable stand 294, and a calibrated tooling flat angle 296 having surfaces 298 and 300 which are at a known angle with reference to each other, corresponding to the desired offset angle for the head assembly 30.

In FIG. 10, the fixture 20 is lying on its side on the flat table 290, with the side positioning reference edge 132 actually supported by the flat table. A temporary support block 302 is employed to support the free end of the post 204, so that the post 204 is substantially parallel to the flat table 290.

In this configuration, it will be appreciated that the primary positioning reference edge 130 is perpendicular to the flat table 290, and that the head assembly 30, and in particular the axis 52 thereof, would be parallel to the flat table 290 if the head assembly 30 were in its reference position. The head assembly 30, however, is not in its reference position, being rotationally offset therefrom by an angle equal to the angle between the surfaces 298 and 300 of the calibrated tooling flat angle 296.

To achieve this, the lower surface 298 of the calibrated flat angle is placed across the post 224 and the cylindrical reference portion 288 of the tooling adjustment element 280. The clamping screw 38 is loosened by means of the enlarged head 40 and the head assembly 30 rotated until the upper surface 300 is parallel to the flat table 280 within desired tolerances. To measure the desired parallelism, the stand 290 for the dial indicator 292 is moved along the surface of the table 290, while observing the dial of the dial indicator 292. When no movement of the dial 292 occurs at all, then the surface 300 of the tooling flat angle is parallel to the flat table 290 and the head assembly 30 is in the desired angular position. At this point, the clamping screw 38 is tightened. After a final check the fixture is ready for use to make a precision cut as shown in FIG. 8.

While specific embodiments of the invention have been illustrated and described herein, it is realized that numerous modifications and changes will occur to those skilled in the art. It is therefore to be understood that the appendant claims are intended to cover all such modifications and changes that fall within the true spirit and scope of the invention.

What is claimed is:

1. A fixture for pin machining, comprising:

a base plate;

a vertically upstanding post secured to said base plate;

a head assembly slidably mounted on said post for at least vertical position adjustment, said head assembly having a pin-clamping portion extending horizontally from said post to a distal end generally along a head assembly axis perpendicular to said post;

said head assembly including on a side of said pin-clamping portion adjacent said distal end a first stationary jaw having a horizontally-oriented workpiece-locating groove facing away from the head assembly axis, and including at said distal end a second stationary jaw having a vertically-oriented workpiece-locating groove facing away from said post; and at least one clamp element for selectively clamping a workpiece pin either against said horizontally-oriented workpiece-locating groove for a horizontal cut-off operation, or against said vertically-oriented workpiece-locating groove for a vertical precision grinding operation.

2. The fixture of claim 1, wherein said workpiece-locating grooves are V-shaped grooves.

3. A fixture for pin machining, comprising:

a base plate;

a vertically upstanding post secured to said base plate;

a head assembly slidably mounted on said post for at least vertical position adjustment, said head assembly having a pin-clamping portion extending horizontally from said post to a distal end generally along a head assembly axis perpendicular to said post;

said head assembly including on a side of said pin-clamping portion adjacent said distal end a first stationary law having a horizontally-oriented workpiece-locating groove facing away from the head assembly axis, and including at said distal end a second stationary jaw having a vertically-oriented workpiece-locating groove facing away from said post;

at least one clamp element for selectively clamping a workpiece pin either against said horizontally-oriented workpiece-locating groove for a horizontal cut-off operation, or against said vertically-oriented workpiece-locating groove for a vertical precision grinding operation; and said head assembly further including an adjustable stop element adjacent said side of said pin-clamping portion for engaging an end of the workpiece pin for locating the workpiece pin.

4. The fixture of claim 3, wherein said adjustable stop element comprises an adjustable stop rod extending alongside said side of said pin-clamping portion parallel to the head assembly axis.

5. The fixture of claim 1, wherein said first stationary jaw has a clearance recess for providing clearance for a head of a relatively short workpiece pin.

6. The fixture of claim 1, wherein:

said second stationary jaw comprises a relatively taller jaw element and a relatively shorter jaw element, said relatively taller and relatively shorter jaw elements having respective vertically-oriented workpiece-locating grooves; and wherein said head assembly is reversible on said post such that either one of said jaw elements may be selectively positioned above the other;

whereby workpiece pins of different lengths may be selectively clamped against at least one of said workpiece-locating grooves.

7. The fixture of claim 1, wherein said post is cylindrical and said head assembly is rotatively adjustable on said post.

8. The fixture of claim 1, wherein said base plate has a primary positioning reference edge perpendicular to the head assembly axis when said head assembly is rotationally in a reference position.

9. The fixture of claim 8, wherein said primary positioning reference edge is located farther from said post than said head assembly distal end.

10. The fixture of claim 8, wherein said base plate has at least one secondary positioning reference edge at a 45° angle with reference to said primary positioning reference edge.

11. The fixture of claim 8, wherein said base plate has at least one side positioning reference edge at a 90° angle with reference to said primary positioning reference edge.

12. The fixture of claim 8, wherein said post is cylindrical and said head assembly is rotatively adjustable on said post.

13. The fixture of claim 12, wherein said post has a vertically-extending graticule line and said head assembly has a graduated degree scale cooperating with said graticule line for facilitating adjustment of said head assembly to a desired rotational position on said post.

14. A fixture for pin machining, comprising:

a base plate;

a vertically upstanding cylindrical post secured to said base plate;

a head assembly slidably mounted on said post for both vertical and rotative position adjustment, said head assembly having a pin-clamping portion extending horizontally from said post to a distal end generally along a head assembly axis perpendicular to said post;

said base plate having a primary positioning reference edge perpendicular to the head assembly axis when said head assembly is rotationally in a reference position, and at least one side positioning reference edge at a 90° angle with reference to said primary positioning reference edge;

said head assembly including on a side of said pin-clamping portion adjacent said distal end a first stationary jaw having a horizontally-oriented workpiece-locating groove facing away from the head assembly axis, and including at said distal end a second stationary jaw having a vertically-oriented workpiece-locating groove facing away from said post;

at least one clamp element for selectively clamping a workpiece pin either against said horizontally-oriented workpiece-locating groove for a horizontal cut-off operation, or against said vertically-oriented workpiece-locating groove for a vertical precision grinding operation;

said head assembly having at least one tooling hole on a tooling hole axis parallel to said post and located intermediate said post and said distal end; and a tooling adjustment element having a plug portion received in said at least one tooling hole and a cylindrical reference portion having the same diameter as said post;

whereby, for adjusting said head assembly to a desired rotational position on said post, said fixture is laid on its side on a flat table with said side positioning reference edge on the flat table, a lower surface of a calibrated tooling flat angle is placed across said post and said cylindrical reference portion, and said head assembly is rotationally adjusted until an upper surface of the tooling flat angle is parallel to the flat table.

15. A fixture for pin machining, comprising:

a base plate;

a vertically upstanding post secured to said base plate;

a head assembly slidably mounted on said post for at least vertical position adjustment, said head assembly having a pin-clamping portion extending horizontally from said post to a distal end generally along a head assembly axis perpendicular to said post;

said head assembly including on a side of said pin-clamping portion adjacent said distal end a first stationary jaw having a horizontally-oriented workpiece-locating aperture parallel to the head assembly axis, and including at said distal end a second stationary jaw having a vertically-oriented workpiece-locating groove facing away from said post; and at least one clamp element for selectively clamping a workpiece pin against said vertically-oriented workpiece-locating groove for a vertical precision grinding operation.

* * * * *